United States Patent [19]

Wepf

[11] 4,234,156

[45] Nov. 18, 1980

[54] SNAP-TIE

[75] Inventor: Alfred Wepf, Brampton, Canada

[73] Assignee: Acrow-Richmond Limited, Rexdale, Canada

[21] Appl. No.: 32,811

[22] Filed: Apr. 24, 1979

Related U.S. Application Data

[63] Continuation-in-part of Ser. No. 34, Jan. 2, 1979, abandoned.

[51] Int. Cl.[3] ..... E04G 9/00; E04G 17/06

[52] U.S. Cl. ..... 249/40; 249/41; 249/214; 249/216

[58] Field of Search ..... 249/42, 40, 41, 213, 249/214, 216, 33, 36

[56] References Cited

U.S. PATENT DOCUMENTS

| | | | |
|---|---|---|---|
| 1,162,554 | 11/1915 | Berry | 249/216 |
| 3,263,956 | 8/1966 | Hawkins | 249/216 |
| 3,430,914 | 3/1969 | Clasen et al. | 249/214 |
| 3,618,887 | 11/1971 | Erikson | 249/213 |
| 3,888,455 | 6/1975 | Mikus | 249/216 |

*Primary Examiner*—Donald J. Arnold

*Attorney, Agent, or Firm*—Rogers, Bereskin & Parr

[57] ABSTRACT

A tie bar for use in positioning forms into which a suitable material such as concrete may be poured comprises a metal bar having a central portion and two end portions. The end portions are intended to be broken away from the central portion at a stress concentrating notch after the concrete has set. A pair of moulded members are moulded directly to the central portion of the bar each of which moulded members comprises at least two flanges extending outwardly from the bar and spaced apart to accommodate a reinforcing rod. The tie is also fitted with two conical spacers which extend axially outwardly from the moulded members and which are conical having the largest diameter facing axially outward to support the form and prevent inward movement of the forms. In one preferred embodiment of the invention the conical spacers are separate from the moulded members. In a second preferred embodiment the conical spacers are integral with the moulded members. The moulded members serve to locate the forms during the pouring stage and to maintain spacing of reinforcing rods within the concrete and after pouring serve to virtually eliminate water passage through the concrete wall along the central portion of the tie. In an embodiment for use with relatively thin walls the moulded members have a single outwardly extending flange and the reinforcing rod may be located by positioning the reinforcing rod against the single flange and the body portion of moulded member.

15 Claims, 7 Drawing Figures

Figure 5:
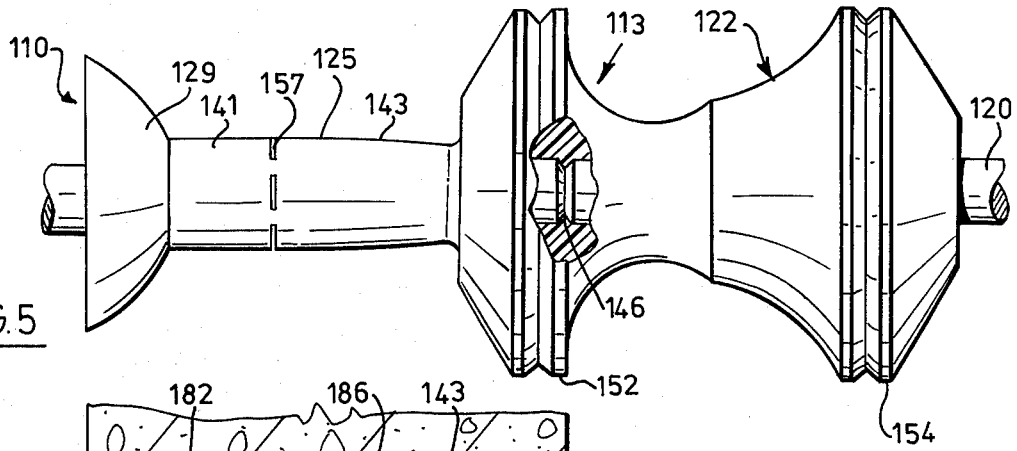

FIG. 1
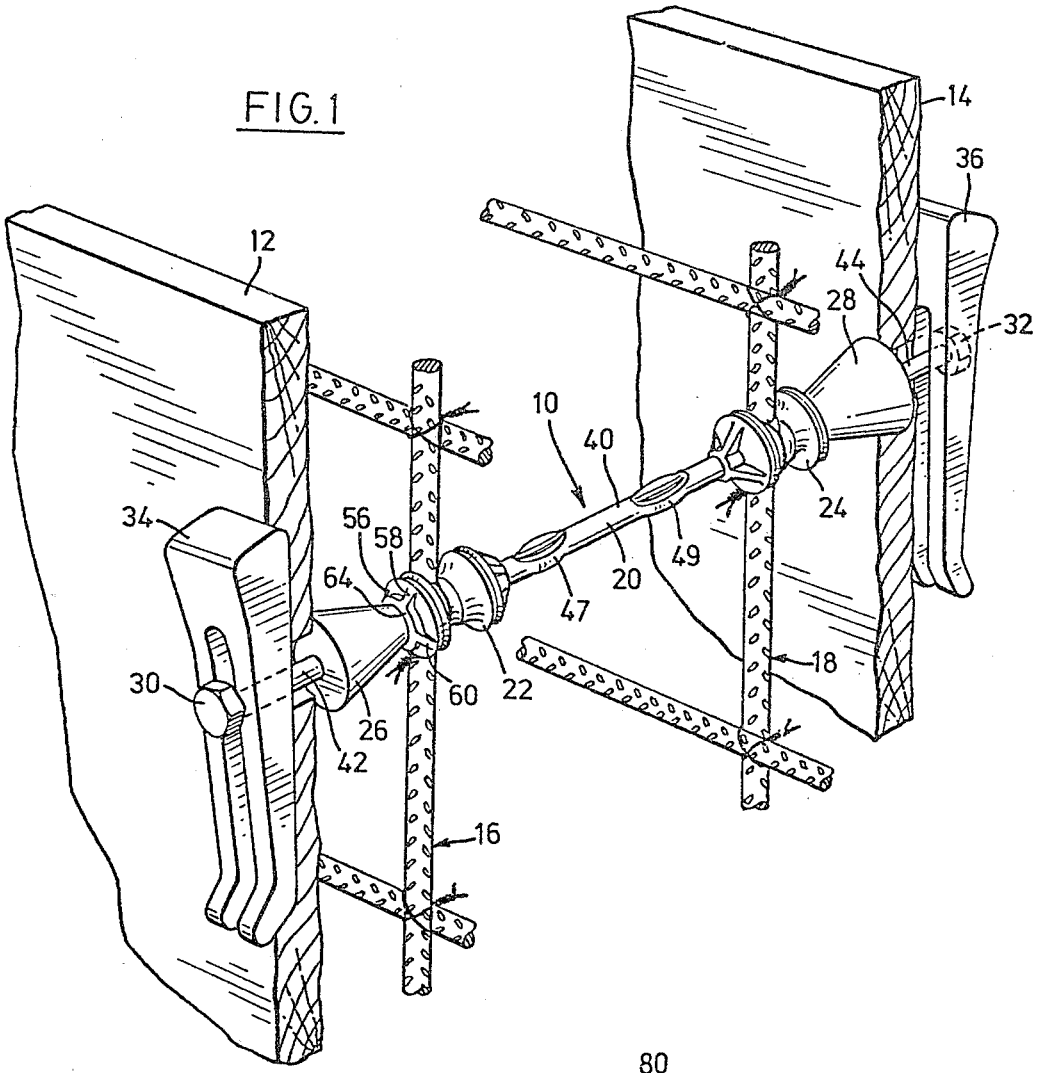
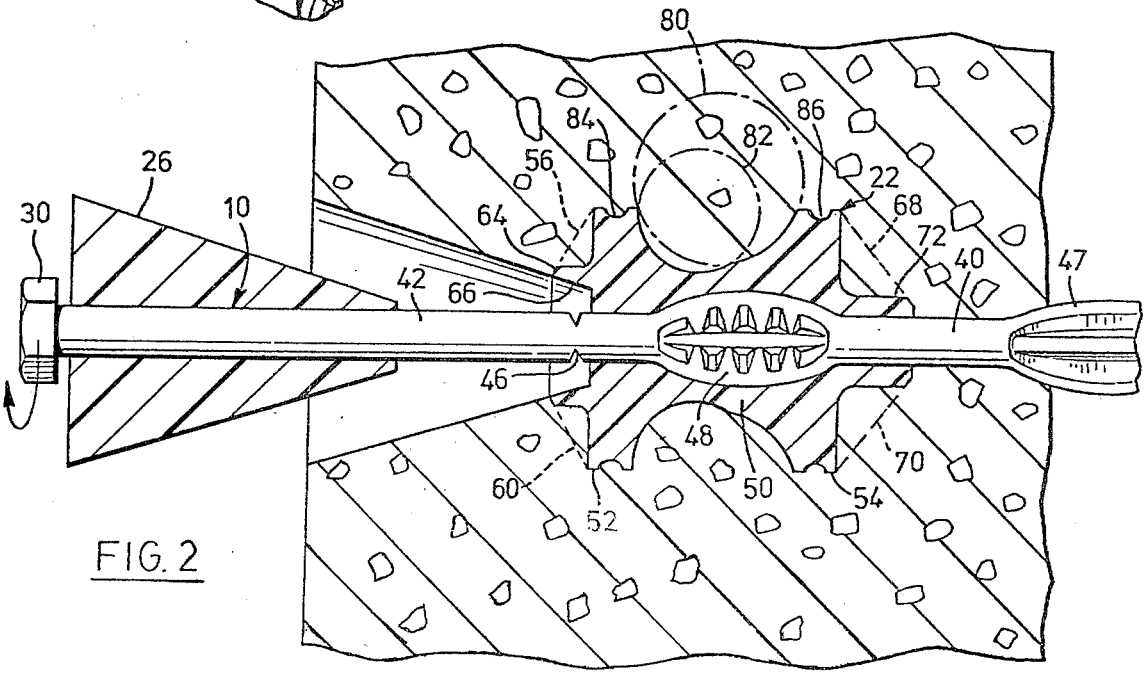
FIG. 2

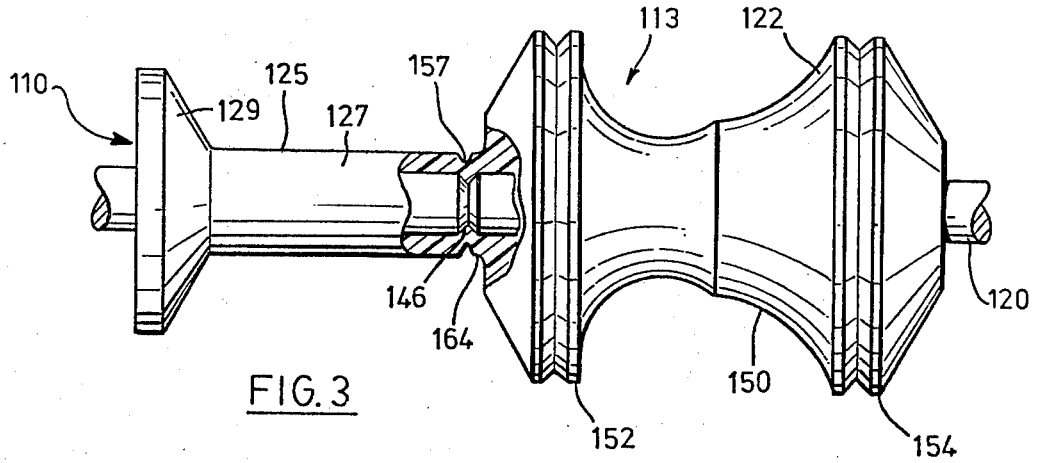
FIG. 3
FIG. 4
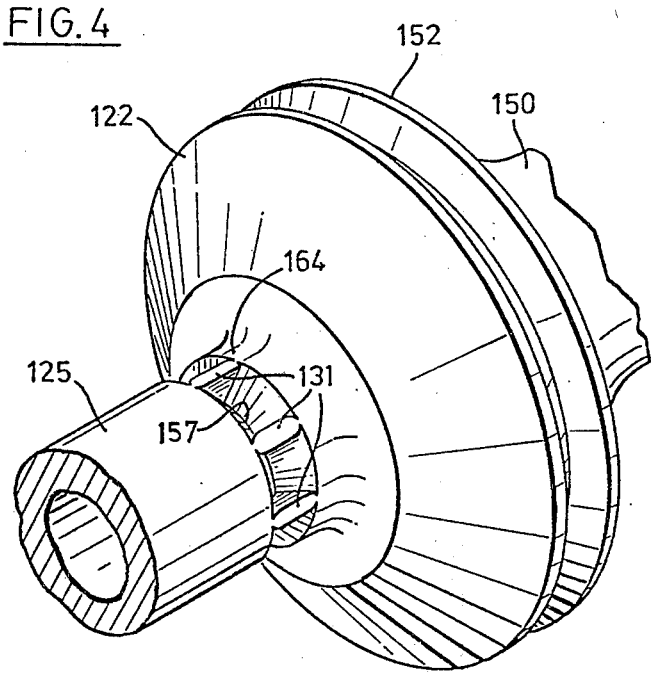

SNAP-TIE

This application is a continuation-in-part of application Ser. No. 34, filed Jan. 2, 1979 and now abandoned.

This invention relates to a tie bar which may be used to position forms for the pouring of settable materials such as concrete, and for locating of reinforcing members within the space into which the settable material is to be poured.

Concrete walls and the like are most often manufactured by the method of installing forms at the desired location of the wall. The forms may be wooden or like members and may be readily assembled and dissassembled after pouring of the concrete for use at subsequent locations. Such forms are installed and spaced in order that the concrete poured between the forms will have the desired configuration after setting. Typically the forms which will define the thickness of a wall are secured to each other by ties. These ties together with various forms of wedges are used to prevent the forms from moving away from each other as the heavy settable material such as concrete is poured into the space between the forms. It is also desirable to ensure that the forms do not move inwardly toward each other. Accordingly, standard ties have been developed which prevent movement of the forms either inwardly or outwardly in order that the thickness of a concrete wall may be accurately maintained.

Many of the ties in use today involve a form of breakable connection between a central portion and end portions of the tie. This breakable portion ensures that after the wall has been poured the portion of the tie which projects outwardly from the wall may be broken off to leave a concrete surface free of projections. A typical example of the so-called SNAP-TY* or breakable tie is disclosed in U.S. Pat. No. 1,857,610 to T. C. Shenk, dated May 10, 1932. In order to position the forms so as to prevent inward movement it has been customary in manufacturing ties to use conical members which bear against the inner surface of the forms. Typically these conical members are located outwardly from the desired tie breaking point such that when the end of the snap-tie is broken off the conical member may also be removed from the concrete. If a finished surface is required on the concrete wall, then the area formerly occupied by the conical member may be filled with grouting and the like.

*SNAP-TY Trade Mark of Richmond Screw Anchor Inc.

One the of the major problems with prior art ties relates to the matter of water seepage through the wall. After each end of the tie is broken and removed the central portion of the tie remains within the wall. However, with the passage of time, as the concrete shrinks, a minute passageway is formed between the central portion of the tie which remains in the wall and the concrete which surrounds the embedded tie. This passageway permits water seepage through the wall along the central portion of the tie. Several attempts have been made to reduce water seepage through the wall, usually by providing a serpentine path for any water.

In many concrete wall constructions it is desired to reinforce the wall with steel reinforcing rod. By and large the reinforcing rod, where desired, comprises a grid having vertical and horizontal members. The grid for such a wall is typically constructed by wiring the various members together where they cross such that the entire grid is substantially supported. The location of the reinforcing rod is carefully controlled. As a heavy material such as concrete is poured into the space between the forms there is a tendency to move the reinforcing rods unless the rods are firmly located with respect to the forms. Many attempts have been made to provide means of locating the reinforcing rod with respect to the surface of the forms. In typical grids having vertical and horizontal rods the vertical rod is closest to the surface of the poured wall with the horizontal rods being tied to the vertical rods, but inwardly of the vertical rod. When designing a reinforced structure such as a wall the designer usually specifies a precise location of the vertical rod with respect to the surface of the poured concrete wall. Typically, this spacing may be of the order of forty (40) millimeters from the edge of the reinforcing rod to the surface of the wall.

According to this invention there is provided a tie bar for use with forms containing a pourable, settable material comprising a bar and two moulded members, said bar including two stress concentrating notches, a central portion between said two stress concentrating notches and two end portions, and wherein said moulded members are moulded to said central portion of said bar and comprise a body portion and a flange portion extending radially outwardly from said body portion whereby reinforcing rod may be positioned against said body portion and said flange portion.

According to a further embodiment of this invention there is provided a tie bar for use with forms containing a pourable, settable material comprising a bar and two moulded members said bar including two stress concentrating notches, a central portion between said two stress concentrating notches and two end portions, and wherein said moulded members are moulded to said central portion of said bar and comprise a body portion and a flange portion extending radially outwardly from said body portion whereby reinforcing rod may be positioned against said body portion and said flange portion, and wherein each of said moulded members comprises a reinforcing rod positioning portion and an integral spacer portion, said spacer portion having a stress concentrating notch therein to facilitate fracture of said moulded material.

According to a further embodiment of this invention there is provided a tie bar for use with forms for containing a pourable settable material comprising a bar and two moulded members, said bar including two stress concentrating notches, a central portion between said two stress concentrating notches and two end portions, and wherein said moulded members are moulded to said central portion of said bar and comprise a body portion and at least two flanges extending outwardly from said body portion and having a groove in said body portion between said flanges whereby reinforcing rod may be positioned between said flanges.

According to a further embodiment of this invention the moulded members may comprise integral spacers having stress concentrating notches for facilitating fracture of said moulded material. Advantageously the stress concentrating notches of the steel bar may be located within the reinforcing rod supporting portion of the moulded member such that upon fracture and removal of a portion of the steel bar a cylindrical portion of said moulded members present a hollow cylindrical bore into which may be inserted the plug.

Figure 6:
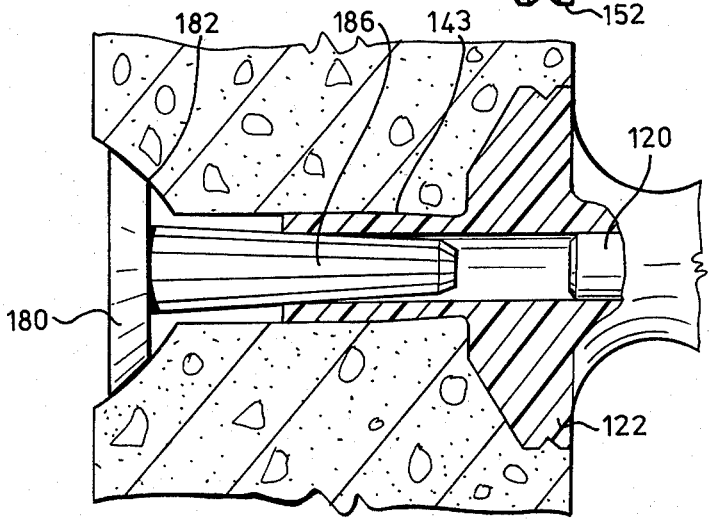
Figure 7:
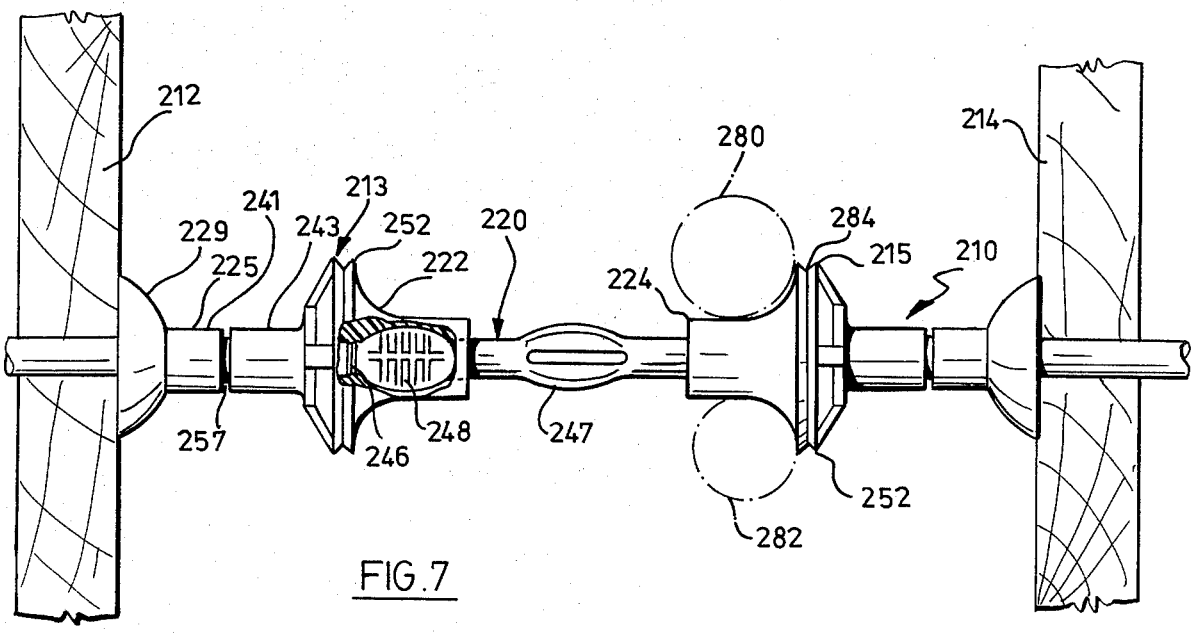

Four embodiments of the invention are illustrated in the following drawings in which:

FIG. 1 illustrates a tie bar according to one form of the invention in position between two forms with reinforcing rod wired thereto ready to receive concrete, FIG. 2 is a horizontal cross-section through the tie of FIG. 1 after pouring of concrete and removal of the forms, FIG. 3 is an alternate form of moulded member incorporating an integral spacer, FIG. 4 is an enlarged detail view of the form of moulded member of FIG. 3 illustrating the notch portions of the bar and moulded member which are aligned, FIG. 5 illustrates an alternate form of moulded member incorporating an integral spacer, FIG. 6 is an enlarged detail view of the form of moulded member of FIG. 5 illustrating the moulded member after fracture and removal of the end portion of the tie bar and illustrating a plug inserted into the cylindrical bore of the remaining portion of the moulded member, and FIG. 7 illustrates a tie bar according to another form of the invention in position between two forms which are relatively closely spaced together to form a wall of less thickness than illustrated in FIG. 1.

FIG. 1 shows the tie bar indicated generally as 10 in position between two forms 12 and 14. Attached to the tie bar 10 are portions of two reinforcing rod grids indicated generally as 16 and 18.

The tie bar 10 comprises a steel wire or bar 20, two moulded members 22 and 24 and two truncated conical spacers 26 and 28. Steel bar 20 is equipped with a head or similar boss 30 and 32 at each tip. As is apparent from FIG. 1 slotted wedges 34 and 36 are used to bear against respective heads of the tips of the bar 20 and against the forms. The forms bear against the larger diameter of the truncated cones such that the entire assembly is rigid.

The steel bar 20 will have suitable strength as required by the weight and pressure of concrete to be poured and the spacing of ties to hold the forms. Typically such ties are spaced 600 millimeters on centers and the bar will be sized such as to provide appropriate support for the forms depending upon the nature of the concrete to be poured into the forms. The bar 20 comprises a central portion 40 and end portions 42 and 44. The central portion 40 is delineated from the end portions by two notches. One of these notches 46 is shown in FIG. 2. A similar notch is located substantially within moulded member 24 as explained hereinafter. These notches are provided in the bar 20 so as to provide convenient points of weakness or stress concentrations. As will be well understood by those skilled in this art the tie may be broken at the stress concentrating notches after the concrete has been poured prior to removal of the forms in order that the wall can be left with a smooth surface without projecting tie members.

Moulded members 22 and 24 are moulded directly on the central portion 40 of bar 20. It is to be observed that bar 20 comprises a toothed flattened portion 48 in the viscinity where each moulded member is to be moulded on the bar 20. One of these flattened portions is shown as 48 in FIG. 2. It will be appreciated that a similar flattened portion is located on bar 20 within moulded member 24. These toothed flattened portions ensure that the moulded member 24 is rigidly moulded to the bar 20. The moulded member cannot be slid axially along the bar nor rotated about the bar.

Moulded member 22 is shown in greater detail in FIG. 2. It will be understood that members 22 and 24 are essentially similar and the description will be confined to member 22 as shown in FIG. 2. Moulded member 22 is of essentially a pulley shape having a central or body portion 50 which is of a lesser diameter than radially projecting flange portions 52 and 54. Moulded member 22 is moulded directly on to bar 20 and accordingly will not have any interior passageway therethrough between the moulded member and central portion 40 of the bar. As shown in FIG. 2 the bar 20 projects centrally through moulded member 22. At the outermost end of moulded member 22 there are a series of four centrally and evenly spaced axially extending ribs three of which are visible 56, 58 and 60. These ribs extend outwardly in the axial direction and radially inward from flange 52 to define a boss 64. Within boss 64 there is provided a compartment 66 extending axially inwardly of member 22. As shown in FIG. 2 the notch 46 provided to assist breakage of the tie bar at this point is located within the recess 66. The material from which member 22 is moulded does not fill or otherwise coact with the notch 46. The axially inner tip of member 22 also comprises a series of four axially extending ribs which taper inwardly in the axial direction and radially inwardly. Two of these ribs 68 and 70 are visible in FIG. 2. These ribs taper radially inwardly to a solid boss 72.

It will be understood that when member 22 is moulded to bar 20 the flat portion 48 will be completely surrounded by the moulded material comprising member 22. Accordingly, it will not be possible for member 22 to rotate about a central portion of 40 of the bar or to move axially along the bar. The ribs at either end of member 22, are each provided to ensure that member 22 becomes firmly surrounded and embedded in the poured concrete. Once the concrete has hardened these ribs assist in ensuring that the member 22 cannot be rotated within the concrete. It will also be observed that central portion 40 of bar 20 comprises two additional flattened portions 47 and 49. These flattened portions are not within the moulded members and will therefore be surrounded by concrete after pouring. All of the foregoing ensure that the tie will not rotate in the concrete after setting. This will assist in the breakage of the tie at the notches using a socket wrench designed for the purpose as will be well understood by those skilled in the art.

With respect to FIGS. 1 and 2 it may be observed that the tie bar 10 comprises a pair of truncated conical spacers 26 and 28. These conical spacers 26 and 28 have their base or greatest diameter facing outwardly and their minimum diameter facing inwardly. Spacers 26 and 28 which may be moulded from similar material as members 22 and 24 have an axial hole therethrough and are slideable and rotatable on bar portions 42 and 44 respectively. As apparent in FIG. 2 spacer 26 has a smaller diameter such that the smaller diameter can enter within member 22 to contact the inner surface of boss 64. Conical spacer 26 may be slid into close engagement with boss 64 thereby closing recess 66. This ensures that no concrete will be permitted to come in contact with end portion 42 or with the notch 46. The conical spacers 26 and 28 thus ensure that the notches remain free of concrete after the concrete is poured between the forms and at the same time act to provide support for the interior surface of the forms such that the forms cannot move inwardly and thereby decrease the thickness of the wall. When the tie bar has performed its function the tie may be broken at the notch 46 and the spacers and end portions may be removed and the void filled with grouting.

The central or body portion 50 of moulded member 22 comprises a pair of radii extending between flange portions 52 and 54. It will be observed that the curve having the shortest radius is outwardly of the curve having the greater radius. When spacing reinforcing rod most designers will specify with accuracy the minimum dimension between the surface of the concrete wall and the outermost surface of the vertical reinforcing rod contained within the wall. Typically, this dimension is forty (40) millimeters. According to this invention the spacing of the reinforcing rod with regard to the outer surface of the wall is accurately maintained. The location of vertical reinforcing rods is fixed by the moulded members.

The use of the tie bar can best be understood with reference to FIG. 1. Form 14 is first located at the desired position. The tie 10 is assembled to the form 14 by passing the head 32 through a hole in the form and securing with the wedge 36. Vertical reinforcing rods of grid 18 are then positioned according to the following method. A reinforcing rod is positioned against member 24 within the central portion 50 as shown in FIG. 1. A large diameter rod 80 may be brought into contact with the larger radius as shown in phantom outline in FIG. 2 and the reinforcing rod tied to the member 22 with the typical form of tying wire. If a smaller diameter reinforcing rod 82 is used, then as illustrated in FIG. 2 this rod may also be tied to the moulded item 22 using the smaller radius curve and outward flange to position the rod. Typically, today reinforcing rod of either 15 mm or 20 mm diameter sizes are used. However the moulded items 22 and 24 could be manufactured with any suitable curves or combination of radii to allow for the positioning of different size of reinforcing bar.

Once all the vertical rods of grid 18 have been located by tying the same to the moulded member 24 of several ties as may be appropriate, the horizontal rod of the grid may be positioned and tied in place by tying the horizontal rods to the vertical rods as required. The diameter of the flange portions 52 and 54 of the moulded member 24 is kept sufficiently small that it does not interfere with the horizontal rod which may thus be tied to the vertical rod at any convenient location. The methods of tying reinforcing rods are well understood by those skilled in the art. This method may be easily adopted to tying the rods to the tie bar.

After all the rods of grid 18 have been tied in place, the horizontal rods of grid 16 are placed loosely on the tie bars. When all horizontal rods have been loosely positioned, the vertical rods of grid 16 may be tied to moulded member 22 of the tie bars as appropriate. This is done in the same manner as explained with respect to grid 18. After the vertical rods have been tied to the tie bars, the horizontal rods may be lifted up from their resting place and tied to the vertical rods. When all tying has been completed form 12 is passed over the heads 30 and positioned against the spacer 26. Form 12 is then secured by means of wedge 34 to create a rigid structure in which the forms and reinforcing rods are all accurately and rigidly located ready for pouring of concrete.

After all the reinforcing rod is tied in place the concrete may be poured into the forms. When the concrete has set wedges 34 and 36 are removed and the ends 42 and 44 can be broken with a socket wrench. Forms 12 and 14 may thereafter be taken away from the wall. The notches act as stress concentrators or points of weakness to ensure that the tie will break at each notch. As neither the notch 46 nor end portion 42 is in contact with the concrete any torque applied to each portion 42 passes along end portion 42 through notch 46 to central portion 40. Moulded member 22 with its flanges and ribs surrounded by concrete acts against flattened portion 48 together with flattened portions 47 and 49 to anchor the tie bar. Accordingly, the tie bar will break at notch 46. Conical spacers 26 and 28 may be removed and the corresponding void filled with grouting.

It will be observed that the tie bar as illustrated in the figures greatly assists in reduction in the amount of water that may pass along the tie bar through the wall. By moulded members 22 and 24 directly on the central portion 40 of the tie bar there is no central access through members 20 and 24 through which water can pass. Accordingly, in order for water to pass along the tie bar it must flow around the periphery members 22 and 24. With its essentially pulley shaped configuration members 22 and 24 each provide a serpentine path which will serve to virtually eliminate the possibility of water flow around the moulded members. Grooves 84 and 86 are provided in the outer periphery of flange like portions 52 and 54 respectively to further assist in this regard. It will be appreciated that after pouring of the concrete, member 22 will be intimately surrounded with concrete. At the same time members 22 and 24 have accurately located the reinforcing rod to be contained within the wall and may be spaced from the surface of the wall any convenient distance by means of conical spacers 26 and 28.

The embodiment of the invention illustrated in FIGS. 3 and 4 differs from that shown in FIGS. 1 and 2 in that the spacer is an integral part of the moulded member. The moulded member indicated generally as 113 comprises a reinforcing rod locating portion 122 and a spacer portion 125.

The reinforcing rod locating portion 122 is essentially similar to moulded member 22. This portion comprises two radially extending flange like portions 152 and 154. The flanged portions are spaced apart and are connected by two radii forming a central portion 150 in order that reinforcing rod may be tied between the flanges as explained above.

The stress concentrating notch 146 of tie bar 110 is located axially outwardly of reinforcing rod locating portion 122. Unlike moulded member 22, portion 122 does not contain any recess within boss 164. In this embodiment the stress concentrating notch will contain moulded material. However, as shown in FIG. 3 at 157, the moulded material over the notch is relatively thin.

The spacer portion 125 comprises a cylindrical portion 127 and a frusto-conical portion 129. The frusto-conical portion has its larger diameter at the outward end thereof and will bear against the inner surface of a form in a similar manner to spacer 26.

The moulded member 113 is moulded as a single moulding to steel bar 120. As most of the material is required to manufacture portion 122 and as a single injection passage is preferable, small flow passageways are provided between portions 122 and 125. Three of such passages are evident from the moulded material remaining after injection at 121. Preferably the diameter of cylindrical portion 127 is not substantially greater than the steel bar 120. In addition, frusto-conical portion 129 comprises a relatively shallow steep angle cone. Each of the foregoing steps will assist in saving on the quantity of moulded material required to manufacture moulded member 113. The moulded portions 127 and 129 must, however, be radially thick enough to be able to support the axial thrust loading exerted by the form when the tie bar is fixed to the form with the usual wedges. The thickness of the moulded material will be a function of the strength of the material used and the thrust imposed.

It is to be observed that there is very little moulded material at notch 157. It is likely that this thin material will fracture in compression as the wedges are applied to the tie bar. In order to limit the movement of portion 125 axially along tie bar 110 toward potion 122, the axial length of notch 157 is kept as small as conveniently possible consistent with the mould design requirements.

Moulded member 113 cannot rotate about steel bar 120 as the steel bar is provided with a toothed flattened portion which is encapsulated by portion 122. The tie bar is assembled to the forms and reinforcing rod tied to the tie bar in the same manner as described previously. When the tie bar is broken with a socket wrench after the concrete has set, portion 125 is removed and a comparatively smaller hole is left to be filled with grouting. If the moulded material at 157 has fractured during the installation step then breaking and removal of portion 125 is facilitated. Even if fracture did not occur as wedges were applied, the moulded material will fracture at 157 when torque is applied to the tie bar which will break at notch 146.

This single step moulded member is advantageous in that there is no separate cone to slide along the tie bar prior to installation in the forms.

FIGS. 5 and 6 illustrate a variation of the embodiment of the invention illustrated in FIGS. 3 and 4. In FIG. 5 the moulded member 113 comprises a reinforcing rod locating portion 122 and a spacer portion 125 similar to that shown in FIG. 3. However, tie bar 110 contains a stress concentrating notch 146 which is located within portion 122 of moulded member 113.

The spacer portion 125 comprises a generally frusto-conical portion 129, a cylindrical portion 141 and a second cylindrical portion 143. Cylindrical portions 141 and 143 are separated from one another by a stress concentrating notch 157 in the moulded member. The spacer portion 129 may be conical that is having straight sides or may have a curved surface so as to leave a generally cotyloid recess in the poured material.

The embodiment shown in FIG. 5 acts in a manner similar to the embodiment described above and as shown in FIGS. 3 and 4. The exception however, is that upon applying torque to the tie bar 110 after the concrete has been poured the moulded member will fracture at stress concentrating notch 157 and the tie bar will fracture at stress concentrating notch 146. As shown in FIG. 6 removal of the portion 129 and the attached cylindrical portion 141 of the spacer portion will leave the cylindrical portion 143 attached to the reinforcing rod locating portion 122. It will also be observed from reviewing FIG. 6 that the steel bar 120 will be broken at a point which is inside portion 122. There is thus provided a cylindrical bore within cylindrical portion 143. FIG. 6 shows the tie bar after removal of portions 129 and 141 of the moulded member and after removal of the outer portion of the steel bar.

In FIG. 6 a plug 180 has been inserted in the hole in the concrete left after removal of these portions. It will be observed that the plug 180 comprises a frusto-conical portion 182 and a tapered cylindrical portion 186. The frusto-conical portion 182 is provided with approximately a conical angle which co-operates with the angle or curve of portion 129 of moulded member 113 such that the plug will fit into the void remaining in the concrete after removal of portion 129. Tapered cylindrical portion 186 of plug 180 has a diameter at its inner end which is slightly less than the diameter of the steel bar 120 of tie bar 110. It will also be observed that the cylindrical portion 186 is of significant axial length. This portion 186 of the plug 180 will extend within the bore of cylindrical portion 143 of the moulded member 113. The plug most conveniently may be made of a similar material to moulded member 113. This tapered cylindrical portion 186 of the plug can be force fit or jammed into the bore until the conical portion 182 contacts the concrete. The cylindrical portion 186 is fluted to facilitate insertion and retension of the plug within bore 143.

In other respects the embodiment of the invention shown in FIGS. 5 and 6 is similar to the embodiment shown in FIG. 3.

FIG. 7 illustrates an embodiment of the invention for use with walls which do not have a significant thickness. When the wall to be poured is not particularly thick there may not be room to mould on the steel bar moulded members having two radially extending flanges for positioning reinforcing rod. Although the wall is thinner than the embodiment shown in FIG. 6 the reinforcing rod must be the same distance from the surface of the wall after the concrete has been poured. As stated hereinbefore architects when specifying reinforced walls will usually specify the depth of concrete from the surface of the concrete to the closest surface of the reinforcing rod. For this reason the moulded member must be the same distance from the surface of the wall regardless of the thickness of the wall. In FIG. 7, two hundred series numbers have been used to identify elements which correspond with similar elements shown in previous figures.

Tie bar 210 is indicated generally in position between two forms 212 and 214.

The tie bar 210 comprises a steel wire or bar 220 and two moulded members 213 and 215. The moulded members 213 and 215 are essentially similar with member 213 being shown in partial section to illustrate a portion of the tie bar 220 extending therethrough.

Moulded member 213 comprises a reinforcing rod locating portion 222 and a spacer portion 225 similar to that shown in FIG. 5.

The spacer portion 225 comprises a generally frusto-conical portion 229, a cylindrical portion 241 and a second cylindrical portion 243. Cylindrical portions 241 and 243 are separated from one another by a stress concentrating notch 257 in the moulded member.

As shown in FIG. 7 the steel bar 220 of tie bar 210 comprises a flattened portion 248 which is embedded in the reinforcing rod portion 222 of moulded member 213. This flattened portion 248 ensures that the steel bar 220 cannot rotate within the moulded member. The steel bar also comprises a single flattened portion 247 which is centrally located and which will be completely surrounded by concrete when the concrete is poured between the forms 212 and 214. This flattened portion 247 helps to ensure that the steel bar 220 cannot rotate in the concrete. The tie bar 210 also comprises a stress concentrating notch 246 located within reinforcing rod locating portion 222 of moulded member 213. The flattened portions help to anchor the tie bar 210 in the concrete to facilitate breakage at the stress concentrating notches.

As will be apparent from the desciption taken with reference to FIG. 5, when torque is applied to tie bar 210 the bar 220 will fracture at stress concentrating notch 246 while the moulded member 213 will fracture at the stress concentrating notch 257. Similarly, the bar will be fractured at a stress concentrating notch located within moulded member 215 at a similar stress concentrating notch in the moulded member 215 such that no portion of the bar 220 will project beyond forms 212 and 214 after breaking thereof.

The moulded members 213 and 215 are each adapted to locate reinforcing rod by means of a radially extending flange 252. The radially extending flange 252 comprises an annular groove 284 extending around the outer periphery thereof so as to better resist the passage of water around the radially extending flange. As shown in FIG. 7 with respect to moulded member 215, reinforcing rod may be positioned adjacent to the radially flange 252 and body portion 224. Radially extending flange 252 joins the body portion 224 of the moulded member 215 in a smooth curve which is of a radius of convenient size. Reinforcing rod 280 or 282 shown in phantom lines may be positioned adjacent the radially extending flange and wired to the moulded member 215 in a manner similar to that explained with regard to FIG. 1. Of course, two sizes of reinforcing rod would not be used at the same time in most typical situations. The two rods 282 and 280 are shown merely for the purposes of illustration to indicate that even though a single radius is used for the curve joining flange 282 to the body portion 224 of member 215 larger radius rod may also be conveniently positioned by means of the radially extending flange and the body portion. The reinforcing rod is not as readily positioned with the embodiment shown in FIG. 7 as with the embodiment shown in the previous figures. However, where the thickness of the wall and the spacing of the reinforcing rod from the surface thereof require moulded members having single radial flanges only, the embodiment illustrated in FIG. 7 is considered particularly useful. It should be realized that if a form of moulded member as shown in the previous figures having two radially extending flanges was used with a tie bar of such limited width as shown in FIG. 7 there would not be a suitable portion of the bar 220 to be flattened and enclosed in the concrete. This would then give rise to a situation where the tie bar might not be sufficiently located in the concrete so as to resist the torque required to fracture the tie bar at the two stress concentrating notches.

In all other respects the tie bar 210 is similar to the tie bars described hereinbefore and is used in a similar manner.

Thus, there is disclosed a relatively simple snap-tie which inhibits water leakage through the wall while at the same accurately supporting the forms and supporting reinforcing rod to be contained within the wall and which maintains such locations when a heavy material such as concrete is poured into the forms.

I claim:

1. A tie bar for use with forms for forming a wall of a pourable, settable material comprising a bar and two moulded members;

said bar including two stress concentrating notches, a central portion between said two stress concentrating notches and two end portions, said wherein said moulded members are moulded to said central portion of said bar and comprise a body portion and a flange portion extending radially outwardly from said body portion whereby reinforcing rod may be positioned against said body portion and said flange portion, said tie bar comprising two moulded spacer portions each having a flat distal facing surface adapted to bear against one of said forms and to positively locate said form with respect to said tie bar;

said spacer portions and moulded members together positively locating a reinforcing rod positioned against said body and flange portion with respect to the surface of said wall.

2. A tie bar for use with forms for forming a wall of a pourable, settable material comprising a bar and two moulded members;

said bar including two stress concentrating notches, a central portion between said two stress concentrating notches and two end portions.

and wherein said moulded members are moulded to said central portion of said bar and comprise a body portion and a flange portion extending radially outwardly from said body portion whereby reinforcing rod may be positioned against said body portion and said flange portion, and wherein each of said moulded members comprises a reinforcing rod positioning portion and an integral spacer portion, said spacer portion having a stress concentrating notch therein to facilitate fracture of said moulded material, each said integral spacer portion comprising a flat distal facing surface adapted to bear against one of said forms and to positively locate said form with respect to said tie bar, said spacer portions and moulded members together positively locating a reinforcing rod positioned against said body and flange portion with respect to the surface of said wall.

3. The tie bar of claim 2 wherein said moulded member comprises a plurality of ribs adapted to be embedded in said settable material, and wherein said bar comprises flattened portions at the said central portion where said moulded members are moulded to said central portion, and wherein said central portion of said bar comprises a flattened portion adapted to be embedded in said settable material.

4. The tie bar of claim 3 wherein said stress concentrating notches of said bar are located within the reinforcing rod supporting portion whereby upon fracture and removal of said end portions of said bar said moulded member comprises a cylindrical bore for insertion and retention of a plug.

5. The tie bar of claims 2, 3 or 4 wherein the reinforcing rod is tied to at least one of said moulded members.

6. A tie bar for use with forms for forming a wall of a pourable settable material comprising a bar and two moulded members;

said bar including two stress concentrating notches, a central portion between said two stress concentrating notches and two end portions;

and wherein said moulded members are moulded to said central portion of said bar and comprises a body portion and at least two flanges extending outwardly from said body portion and having a groove in said body portion between said flanges whereby reinforcing rod may be positioned between said flanges, said tie bar further comprising two moulded spacer portions each having a flat distal facing surface adapted to bear against one of said forms and to positively locate said form with respect to said tie bar, said spacer portions and moulded members together positively locating a reinforcing rod positioned between said flanges with respect to the surface of said wall.

7. The tie bar of claim 6 wherein said moulded members comprise a plurality of ribs adapted to be embedded in said settable material, and wherein said bar comprises flattened portions at the said central portion where said moulded members are moulded to said central portion, and wherein said central portion of said bar comprises a flattened portion adapted to be embedded in said settable material.

8. The tie bar of claim 7 wherein each moulded member comprises a boss at the outwardly portion thereof, which boss includes a hollow inner compartment, and wherein each of said stress concentrating notches is located within said compartment of each of said moulded members respectively.

9. The tie bar of claim 8 further comprising two frusto-conical spacers mounted on said end portions of said bar with the greater diameter of said spacers extending toward the tips of said end portions and the angle of said cone of said spacer and the minor diameter chosen such that said cone may extend into said compartment whereby settable material may not flow into said compartment when said spacer contacts said moulded member.

10. The tie bar of claim 9 wherein said body portion of each of said moulded members comprises a groove having a cross-section of two circular curves.

11. The tie bar of claims 8, 9 or 10 wherein a reinforcing rod is tied to at least one of said moulded members.

12. The tie bar of claim 7 wherein each of said moulded members comprises a reinforcing rod positioned portion and an integral spacer portion, and wherein each of said moulded members comprises a reinforcing rod positioning portion and an integral spacer portion, said spacer portion having a stress concentrating notch therein to facilitate fracture of said moulded material.

13. The tie bar of claim 12 wherein said stress concentrating notches of said bar are located within the reinforcing rod supporting portion whereby upon fracture and removal of said bar said moulded member comprises a cylindrical bore for insertion and retension of a plug.

14. The tie bar of claim 13 wherein said body portion of each of said moulded members comprises a groove having a cross-section of two circular curves.

15. The tie bar of claim 12, 13 or 14 wherein a reinforcing rod is tied to at least one of said moulded members.

* * * * *